United States Patent [19]

Lamberts et al.

[11] 4,221,950

[45] Sep. 9, 1980

[54] METHOD AND APPARATUS SUITABLE FOR HEATING RELATIVELY POORLY CONDUCTING SUBSTANCES

[75] Inventors: Kurt Lamberts; Jürgen Leppin, both of Clausthal-Zellerfeld; Berndt Greten; Harry Neubauer, both of Springe, all of Fed. Rep. of Germany

[73] Assignee: Bison-Werke, Bahre and Greten GmbH & Co. KG, Springe, Fed. Rep. of Germany

[21] Appl. No.: 905,562

[22] Filed: May 12, 1978

[30] Foreign Application Priority Data

May 17, 1977 [DE] Fed. Rep. of Germany ..... 2722348

[51] Int. Cl.[2] ..... H05B 9/04

[52] U.S. Cl. ..... 219/10.81; 219/10.77; 219/10.71; 156/274; 34/1

[58] Field of Search ..... 219/10.77, 10.81, 10.41, 219/10.75, 10.71; 156/274, 380; 333/17; 34/1; 334/50, 51

[56] References Cited

U.S. PATENT DOCUMENTS

| | | | |
|---|---|---|---|
| 2,467,782 | 4/1949 | Schuman | 333/17 |
| 2,473,041 | 6/1949 | Urbain et al. | 219/10.81 |
| 2,546,004 | 3/1951 | Kinn | 219/10.81 |
| 2,549,399 | 4/1951 | Tawney | 219/10.81 |
| 2,551,757 | 5/1951 | Mittelmann | 333/17 |
| 2,607,880 | 8/1952 | Owen | 333/17 |
| 2,616,025 | 10/1952 | Kinn | 219/10.81 |
| 2,697,254 | 12/1954 | Gordon | 156/274 |
| 2,723,517 | 11/1955 | Mittelmann | 219/10.81 |
| 3,022,674 | 2/1962 | Cross et al. | 334/51 U |
| 3,177,432 | 4/1965 | Kelln | 334/51 X |

FOREIGN PATENT DOCUMENTS

| | | | |
|---|---|---|---|
| 2113763 | 9/1972 | Fed. Rep. of Germany | 219/10.81 |
| 445683 | 2/1968 | Switzerland | 219/10.81 |

OTHER PUBLICATIONS

"Particle Boards" (Spanplatten), W. Scheibert, published by Leipzig Press, 1958, p. 72.

*Primary Examiner*—Roy N. Envall, Jr.
*Assistant Examiner*—Philip H. Leung

[57] ABSTRACT

Poorly conducting substances, such as chips of cellulose material containing a heat hardenable binder, are heated by passing them between the plates of an operational capacitor supplied with energy from a high frequency generator. An adjustable auxiliary capacitor is connected in parallel with the operational capacitor and is adjusted to match the capacity of the output circuit to the generator with changing conditions of the poorly conducting substances. Coarse initial control is effected by adjusting the separation of the plates of the operational capacitor. The apparatus is especially useful for making chip boards and the like in which a precompressed mass of chips is passed between the plates of the operational capacitor sandwiched between two endless belts.

16 Claims, 2 Drawing Figures

Figure 1:
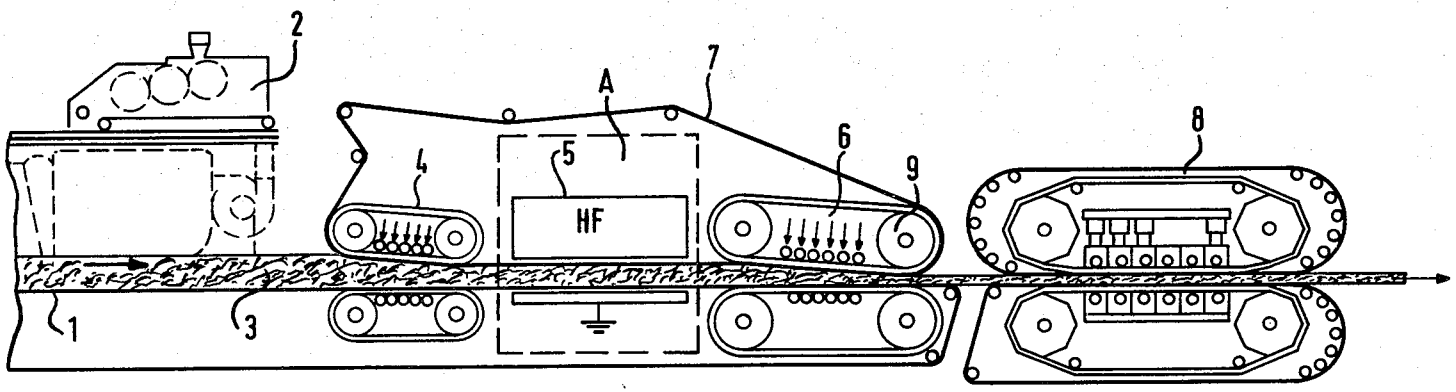

METHOD AND APPARATUS SUITABLE FOR HEATING RELATIVELY POORLY CONDUCTING SUBSTANCES

The invention relates to a method and apparatus suitable for heating relatively poorly electrically conducting substances, in particular substances containing a heat hardenable binder, by the use of high frequency energy and has particular reference to a method and apparatus for heating continually moving masses of substances containing ligno cellulose and/or cellulose and in the form of fleeces, layers, tracks, balls or the like.

In a typical apparatus and method a previously compressed mass of an electrically poorly conducting material is fed between the plates of at least one operational capacitor connected to a high frequency generator and the power output of the high frequency generator is held at least substantially constant by changing the gap between the plates of this operational capacitor.

It is known from DT-AS 21 13 763 to precompress the mass of material so that a mass of material of substantially uniform thickness and structure can be passed through the operational capacitor for the purpose of simplifying the control of the supply of high frequency energy to the mass of material. This precompression yields considerable advantages but is not sufficient to make control of the supply of high frequency energy unnecessary because unavoidable irregularities in the thickness of the mass of material, which result in differential heating of this material in a high frequency field, still occur even with the use of precompression. The effects of differential heating are reduced if a larger air gap is provided between the plates of the operational capacitor. A relatively large air gap leads however to a reduction of the Q factor of the operational capacitor which would once more require a higher frequency of the alternating electrical field in order to achieve, at the permissible field strength in the mass of material, a sufficient power density to guarantee the necessary heating of the mass of material in a relatively short time. The frequency of the alternating electrical field can however not simply be raised as desired because of the legal requirements prevailing in a series of countries concerning the limitation of unwanted radiation from high frequency industrial installations. In general the operational frequency which can be used is preferably the industrial frequency of 27.12 MHz$\pm$+0.6%.

For the purpose of constant power transfer from the high frequency generator to a load in the form of a mass of material which is continually running between the plates of the operational capacitor it is known to change the air gap of the operational capacitor. This control principle however has certain disadvantages. The most significant disadvantage is that the high Q factor of the operational capacitor is associated with very sharp leading and falling edges in the resonance response of the load circuit and thus a very accurate adjustment must be provided for the relatively large and heavy plates of the operational capacitor. Meeting these requirements however gives rise to especial difficulties because the comparatively high speed of the mass of material through the operational capacitor means that only short adjustment times are possible for taking into account the size of the disturbing factor and these cannot be realized by economical measures.

It is also disadvantageous that an enlargement of the gap between the plates of the operating capacitor results in an additional undesired raising of the Q factor of the circuit which leads to an enlargement of the reactive current which in turn bring about increased losses in elements of the matching circuit. Furthermore the control procedure is made more difficult because of the non-linear dependence of the capacity of the operational capacitor on the gap between the plates.

The object of the invention is to so improve the method and apparatus of the previously described kind that a high accuracy of control can be achieved continuously using an optimally small air gap and avoiding the use of expensive and troublesome mechanical adjusting devices.

This problem is solved by the invention in that a coarse adjustment of the spacing of the plates of the operational capacitor takes place in dependence on the DC anode current of the high frequency generator and that on achieving a predetermined value of the DC anode current, a fine control is superimposed by means of an auxiliary capacitor connected in parallel to the operational capacitor which is likewise varied inside a predetermined range in dependence on the DC anode current.

These measures operate, in accordance with the invention, especially advantageously together in the sense of achieving the desired uniform and rapid heating of the mass of material in a continuously operated process because both the prepressing procedure and the superposition of the coarse and fine controls makes possible the provision of a very small air gap which is associated with a desirable reduction of the Q factor and thus a more rapid heating of the mass of material. The reduced Q factor of the circuit causes a reduction in the steepness of the resonance response, so that the auxiliary capacitor provided for carrying out the fine control can be linearly adjusted in a short time using small forces and can fulfil the necessary dynamic requirements without problem. It has been shown that the previously customary air gap of approximately three to five centimeters can be significantly diminished and that air gaps preferably less than or equal to ten millimeters can be achieved without further disadvantages. This is of decisive significance for getting the required power dissipation, and resulting efficiency of heating by means of high frequencies.

An advantageous apparatus for carrying out the method of the invention comprises a carrier for the mass of material, a forming station arranged above this carrier for distributing the mass of material on the carrier, an arrangement for continuously precompressing the mass of material, at least one high frequency heating device with constant power regulation and a continuously working finishing press the apparatus being characterized by the high frequency heating device having control equipment supplied with a signal proportional to the DC anode current of a valve of the generator which, via a first control output, controls a first device for adjusting the air gap of the operational capacitor and which, via a second control output, controls a second device being an adjustable auxiliary capacitor connected in parallel with the operational capacitor.

It is of particular advantage if the auxiliary capacitor is so arranged that a linear dependence of the capacity on the control signal prevails. This means that the practical realization of the control process is significantly simplified.

Preferably, limiting value sensors are associated with the adjustable auxiliary capacitor which are connected with the first adjustment device for adjusting the air gap of the operational capacitor. It is thereby possible, at the ends of the range of adjustment of the auxiliary capacitor, to bring into operation a correspondingly simply arranged adjustment motor for adjusting the separation of the plates of the operational capacitor when the change in capacity required from the auxiliary capacitor lies outside its range of adjustment. This could arise for example when, occasionally, a large irregularity of the height of the mass of material occurs or also with excessive changes in the moisture of this mass of material. The resulting automatic adjustment of the plates of the operational capacitor is followed then by a correspondingly rapid movement of the auxiliary capacitor away from its limiting value in order to achieve a steady state of control once again within its normal working region. The associated release of the limiting value sensor stops the further adjustment of the operational capacitor.

The operational capacitor preferably comprises at least two partial capacitors connected in series symmetrically about a common electrode and the supply of these partial capacitors takes place via energy coupling loops from the resonance chamber of the generator.

This arrangement of the operational capacitor reduces the total load capacity as seen from the generator output terminals to one quarter compared with an arrangement in which only one capacitor plate instead of two partial plates covers the same area of electric field and furthermore this is advantageous because of the fact that the current flow is clearly confined to the area of electric field and does not dissipate in uncontrolled manner through metallic housing parts.

In accordance with another advantageous form of the invention a part of an endless belt is strained against the upper surface of the mass of material being fed through the operational capacitor and the air gap between the upper capacitor plates and said endless belt strained against the upper surface of the mass of material is adjusted to a value in the range of 5 to 25 mm and preferably in the range 6 to 10 mm.

Through the presence of this belt the tendency of the mass of material to expand on leaving the prepress is counteracted which results in the provision of defined conditions within the operational capacitor and an optimally small air gap is made possible.

An especially advantageous form of the invention is characterized by the provision, for each of the partial capacitors, of at least one flap which may be pivoted out of the electrically effective plane of the capacitor. Preferably the pivotable flaps of both partial capacitors are symmetrically arranged relative to the transverse middleplane of the entire capacitor arrangement.

It is thereby possible to match the operational capacitor to the various heights of the masses of material prevailing during the manufacture of boards of various thickness, whilst retaining the symmetrical arrangement of the capacitor about the common conductor, in an exceptionally simple manner so that in practice the smallest permissible air gap can be used for all the commonly prevailing thicknesses of boards.

Figure 2:
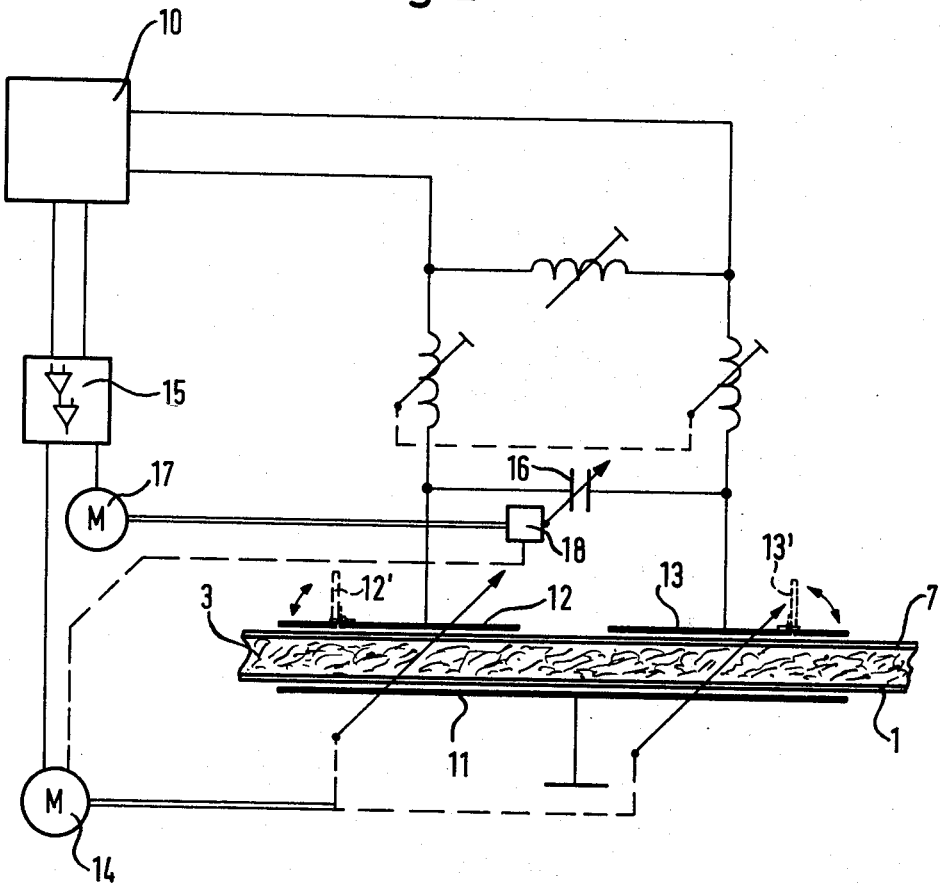

The invention will now be particularly described by way of example only and with reference to the embodiment shown in the accompanying drawings which comprise:

FIG. 1 a schematic illustration of an installation for the continuous manufacture of chip boards and FIG. 2 a further schematic illustration of the unit A of FIG. 1.

Referring firstly to FIG. 1 there is shown a carrier 1 for a mass of material in the form of a fleece of chips, the carrier being an endless belt which is guided over guide rollers and driving rollers (not shown) and which moves continuously in the direction of the illustrated arrow. A forming station 2 is shown schematically illustrated above the carrier 1 and distributes a supplied mixture of chips onto the carrier preferably using the wind sifting process. In principle however any desired suitable forming station can be used. The mass of chips distributed on the carrier belt is referred to as a fleece. The distributed fleece 3 then runs through a precompressor 4 the construction of which can likewise be as desired but which must however guarantee that the mass of chips is brought to an even height and is reduced in thickness by at least one third. Preferably the precompressor brings about an even more pronounced compression. After the precompression the mass of chips, now in the form of a partially consolidated fleece reaches a high frequency heating device 5 whose construction and control will be further described in detail.

The fleece of chips is heated by a high frequency energy within the high frequency heating device 5 so that temperatures from 50° C. to 70° C. or more are achieved in the middle of the fleece of chips.

After passing through the high frequency heating device 5 the heated, and in this condition exceptionally easily compressible fleece reaches a prepress 6 in which the mass of chips is strongly compressed so that the fleece leaving this prepress 6 in general already has the desired thickness of the finished board. A further endless belt 7 runs through the precompressor 4, the high frequency heating device 5 and the prepress 6 so that at least the part of the belt between the precompressor 4 and the prepress 6 is strongly tensioned. The further endless belt 7, which is preferably of synthetic material is taken with an output roller 9 of the prepress 6, i.e. is driven thereby, so that the necessary synchronous movement of the further endless belt and the fleece of chips 3 is of necessity achieved. The endless belt 7 counteracts a tendency of the compressed fleece to expand on leaving the precompressor 4 and this means that the electrodes of the operational capacitor of the high frequency heating device 5 can be brought to a minimum spacing one from the other because in the event of irregularities in the height of the fleece the further endless belt prevents contact of the electrodes with the fleece.

The fleece of chips which leaves the prepress 6 is strongly compressed and already has a comparatively high stability as it enters into the finishing press 8, at the output of which is received the desired end-product in continuous form.

The high frequency heating device 5 and especially its control will now be described with reference to FIG. 2. A high frequency generator 10 with preferably a frequency of 27.12 MHz feeds an operational capacitor comprising two part capacitors 11 and 12 and 11, 13 which are symmetrically arranged about a common ground connection. The precompressed fleece 3 is in contact with the fleece carrier 1 and is preferably covered by the synthetic further belt 7, during its passage through the operational capacitor.

It can in some cases also be of advantage with corresponding energy coupling of the generator to operate the arrangement with one of the partial capacitors 11 or 12 or 11, 13 asymmetrically to earth. In this case a capacity change can also be achieved by pivoting parts of the surfaces 12' or 13' out of the electrically effective plane of the plates 12 or 13 respectively of the partial capacitors. The uppermost plates 12 and 13 of the partial capacitors are preferably adjustable together by means of a motor 14 to adjust their spacing from the grounded plate 11 of the capacitor. This adjusting motor 14 is controlled in dependence from the DC anode current of the high frequency generator by way of control equipment 15. An adjustable auxiliary capacitor 16 is connected in parallel with the operational capacitor and is adjustable by means of a motor 17 which is likewise controlled from the control equipment 15.

The end positions of the adjustable auxiliary capacitor 16 can be determined by means of suitable limiting value sensors which are schematically illustrated by the member 18 in the drawing.

The described arrangement makes possible a combined coarse and fine control of the power output of the high frequency generator 10 in dependence on the anode DC current of the high frequency value of the generator. It is of considerable significance that the coarse control, which takes place via the adjustment of the plates 12 and 13 of the capacitor, need only meet relatively small requirements in a dynamic sense because the stringent dynamic requirements placed on the control process can be readily met by the adjustable auxiliary capacitor 16 at little expense or trouble. If, occasionally the range of adjustment of the auxiliary capacitor 16 is insufficient, on account of large irregularities of the fleece of chips, then an adjustment of the plates of the capacitor 12 and 13 takes place via the base value sensor 18 and the motor 14. Such adjustment has the direct consequence that the auxiliary capacity of the auxiliary capacitor returns once more from its limiting value back to its normal working range. The rapidly responsive drive 17 can then once more completely take over the fine control of the auxiliary capacitor. The control circuit illustrated in FIG. 2 makes possible an automatic adjustment of the electrodes of the operational capacitor and this automatic adjustment, in combination with the control of the high frequency power through the auxiliary capacitor 16, brings about the additional possibility of automatic start up either at the beginning of a run or also after the occurence of damage to the installation. Automatic start up can for example take place by means of a suitably programmed circuit which after operation of a single contact results in the operational capacitor 11, 12; 11, 13 being set to the largest plate separation and the auxiliary capacitor 16 to its smallest auxiliary capacity. After achieving this initial position the anode potential of the generator can be automatically switched on and the operational capacitor adjusted in the sense of reducing the separation of the plates. When the anode current has reached a predetermined adjustable value the movement of the plates 12 and 13 is stopped and the drive for the auxiliary capacitor 16 switched on. The auxiliary capacity then sets itself necessarily to the value corresponding to the size of the control, namely at the predetermined value of capacity corresponding to the desired value of the anode current and continuously guarantees the necessary subsequent adjustment during the operation in dependence on the characteristics of the fleece of chips being guided through the operational capacitor.

In practice an especially advantageous form of the subject of the invention comprises the provision of both partial capacitors 11, 12; 11, 13 each with at least one flap 12', 13' each pivotable out of the electrically effective plane of the capacitor, to change the capacity thereof.

It should also be mentioned that a plurality of similar generators with their associated operational capacitors can without difficulty be used in series so that the desired continuous heating of the fleece of chips can be achieved in the desired manner. Similarly it is possible to build the high frequency heating apparatus together with its constant power control, as previously described with reference to FIG. 2, into existing continuous process installations and thus to considerably enlarge the output from these installations.

Whilst in the foregoing control of the operational capacitor and the auxiliary capacitor have been carried out in terms of the DC anode current of a valve of the high frequency generator, and this is the preferred method, it is nonetheless conceivable that adequate control could be exercised by monitoring another parameter of the generator or the process.

We claim:

1. A method of heating a continuously moving mass of relatively poorly electrically conducting material of variable electrical characteristics and height by dissipating relatively high frequency electrical energy from a generator in a load circuit including an operational capacitor and an auxiliary capacitor connected together to the high frequency generator the method comprising, the steps of:

(a) continuously moving the mass of material through a space between the electrodes of the operational capacitor;

(b) continuously monitoring a parameter of the high frequency generator related to the power output from the generator to the load circuit;

adjusting the capacity of the load circuit to adjust the value of said parameter to a value corresponding to a predetermined power dissipation in the moving mass of material;

(c1) said adjusting step (c) including: adjusting the auxiliary capacitor in response to deviations of the monitored parameter from its desired value to change the capacity of the load circuit whereby to effect a fine compensation for changes in the load circuit brought about by variations in the electrical characteristics and height of said moving mass of material and to restore said parameter to its predetermined value;

(c2) sensing when the auxiliary capacitor has reached the limits of its range of adjustment; and (c3) as necessary making a relatively coarse adjustment of the capacitance of the operational capacitor to restore the parameter to its desired value and to reset the auxiliary capacitor to within its range of adjustment.

2. A method according to claim 1 and wherein said parameter comprises the anode current of an electron tube forming part of said high frequency generator.

3. A method according to claim 1 and wherein the steps of adjusting the capacity of the load circuit is effected by varing the electrode separation of said operational capacitor thereof.

4. A method according to claim 1 and wherein the step of making a relatively coarse adjustment of the capacitance of the operational capacitor is effected by varying the effective electrode area of at least one of the electrodes thereof.

5. A method according to claim 4 and wherein the varying of the effective electrode area of at least one of the electrodes of the capacitor comprises the step of pivoting a flap portion of that electrode to a position out of the electrically effective plane of the electrode.

6. Apparatus for heating a continuously moving mass of relatively poorly conducting material of variable electrical characteristics and height by means of high frequency electrical energy, the apparatus comprising: a high frequency generator, a load circuit including an operational capacitor and an auxiliary capacitor connected together to the high frequency generator, means for moving said mass of material between the electrodes of the operational capacitor, control circuit means including a closed-loop controller adapted to monitor a parameter of the high frequency generator related to the power output the generator of the load circuit and to adjust the capacity of the load circuit to adjust the value of said parameter to a predetermined value corresponding to a predetermined power dissipation in the moving mass of material, said control circuit means having means for passing the output of said closed-loop controller to first adjustment means to adjust the auxiliary capacitor in response to deviation of the monitored parameter from its predetermined value to change the capacity of the load circuit to restore said parameter to its predetermined value, first and second limiting value sensors adapted to sense when, following adjustment of the auxiliary capacitor in response to deviation of said parameter, the auxiliary capacitor has reached either of the respective limits of its range of adjustment and operative to activate second adjustment means to adjust the operational capacitor to restore the parameter to its predetermined value whereby said closed-loop controller is automatically operative to reset the auxiliary capacitor to within its range of adjustment, thereby releasing the respective limiting value sensor and terminating activation of said second adjustment.

7. Apparatus in accordance with claim 6 and in which said parameter comprises the DC anode current of an electron tube incorporated in an oscillator of the high frequency generator.

8. Apparatus according to claim 6 and in which, at an upstream position from said means for moving the mass of material between the electrodes of the operational capacitor, there is further provided a forming station for distributing said mass of material in a desired arrangement and a precompressor for at least partially compressing said mass of material.

9. Apparatus according to claim 8 and further comprising a finishing press downstream of the operational capacitor for consolidating said moving mass of heated material.

10. Apparatus according to claim 9 in which said means for moving said mass of material between the electrodes of the operational capacitor comprises a first movable belt arranged beneath the mass of material and in which the apparatus further comprises a second movable endless belt positioned above said mass of material at least over a distance extending from the precompressor to the downstream end of the operational capacitor, there being means for maintaining at least this portion of the second endless belt under tension whereby to reduce the tendency of the mass of material to expand after leaving the precompressor.

11. Apparatus according to claim 9 and in which there is provided a further press upstream of the finishing press and downstream of the operational capacitor for assisting in the consolidation of the mass of material and in which said endless belt passes also through said further press.

12. Apparatus according to claim 6 and in which the adjustable auxiliary capacitor is adapted to provide a linear variation in the capacity of the load circuit in proportion to the control signal supplied by said closed-loop controller.

13. Apparatus according to claim 6 and in which said operational capacitor comprises two series connected part capacitors having a common electrode and in which each of said part capacitors is supplied with energy via a coupling loop from a resonance chamber of the high frequency generator.

14. Apparatus according to claim 6 and in which said second adjustment means comprises means operative to adjust the separation of the electrodes of said operational capacitor.

15. Apparatus according to claim 6 in which at least one of said electrodes of the operational capacitor includes a pivoted flap portion and said second adjustment means is operative to pivot said flap out of the electrically effective plane of the electrode whereby to adjust the capacity of said operational capacitor.

16. Apparatus according to claim 6 and in which the operational capacitor comprises two series connected part capacitors having a common grounded electrode and in which the other electrodes of each of said part capacitors each includes a pivoted flap, the pivoted flaps being symmetrically positioned relative to the transverse plane of the operational capacitor, and said second adjustment means being operative to pivot each of said flaps out of the electrically effective plane of its respective electrode whereby to adjust the capacity of the operational capacitor.

* * * * *